US006595633B2

(12) United States Patent
McCord, Jr. et al.

(10) Patent No.: US 6,595,633 B2
(45) Date of Patent: Jul. 22, 2003

(54) PRINTER PEN CARRIAGE SUPPORT

(75) Inventors: Charles F. McCord, Jr., Corvallis, OR (US); Laura E. Simmons, Corvallis, OR (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/021,957

(22) Filed: Dec. 14, 2001

(65) Prior Publication Data

US 2003/0112313 A1 Jun. 19, 2003

(51) Int. Cl.[7] ..... B41J 23/00; B41J 29/13
(52) U.S. Cl. ..... 347/108; 347/37
(58) Field of Search ..... 347/105, 108, 347/104, 37; 400/283

(56) References Cited

U.S. PATENT DOCUMENTS 4,466,753 A 8/1984 Wilcox
6,095,628 A * 8/2000 Rhome ..... 347/108
6,312,082 B1 11/2001 Lund et al. ..... 347/19

* cited by examiner

*Primary Examiner*—Judy Nguyen
*Assistant Examiner*—An H. Do

(57) ABSTRACT

A printer pen carriage support for a printer is disclosed. The printer pen carriage support includes a cantilever that fits within a groove of a pen carriage and provides support for the pen carriage. Support structures, such as bushings or bearings, may be included to assist in pen carriage movement along the cantilever.

14 Claims, 3 Drawing Sheets

PRINTER PEN CARRIAGE SUPPORT

BACKGROUND OF THE INVENTION

1. Field of the Invention

The present invention relates generally to printers and, more particularly, to a printer pen carriage support.

2. Related Art

Printers employing a pen carriage (also commonly referred to as a print cartridge or a pen assembly) are well known in the art. The pen carriage typically travels along a guide rod, generally perpendicular to the direction of travel of a print media, and dispenses ink onto the surface of the print media to generate a desired printed image.

For example, U.S. Pat. No. 6,299,270 to Merrill discloses in FIG. 1 (reproduced herein as FIG. 1 for convenience) an ink jet printer 10 having a print head carriage 20 that reciprocates along a scan axis 22 on a guide rod 24. The typical guide rod has several drawbacks, such as its relative cost and degree of difficulty in securely attaching its ends to printer chassis supports and precisely aligning within the print mechanism (e.g., guide rod alignment relative to the paper path).

The guide rod must also be designed to be very rigid to provide adequate support for the pen carriage and precisely positioned to provide mechanical alignment between the pen carriage and the print media. Often, multiple guide rods or a guide rod and an additional guide are provided. For example, U.S. Pat. No. 6,283,572 to Kumar et al., which is incorporated herein by reference in its entirety, discloses in FIG. 2 (reproduced herein as FIG. 2) dual support and guide rails 32, 34 for supporting and guiding carriage assembly 20. Alternatively, U.S. Pat. No. 5,971,524 to Nicoloff, Jr. et al. discloses in FIG. 2 (reproduced herein as FIG. 3) a slide rod 36 along with a support bumper 30 which rides along a guide 32 for supporting and guiding carriage 20. Multiple guide rods or a guide rod and additional supports have the same drawbacks as noted above for the single guide rod, but to a greater degree. Furthermore, multiple guide rods or supports for the pen assembly add to the design and manufacturing cost and complexity. As a result, there is a need for an improved pen assembly support.

BRIEF SUMMARY OF THE INVENTION

A printer pen carriage support is disclosed herein. The printer pen carriage support, in accordance with some embodiments, includes a cantilever that fits within a groove of a pen carriage. The cantilever provides the primary support for the pen carriage as it travels along the printer pen carriage support.

In accordance with one embodiment of the present invention, a printer includes a housing, a pen carriage that transports a pen for dispensing a substance onto a sheet of a print media transported near the pen carriage, and a pen carriage support coupled to the housing and which is coupled to and supports the pen carriage by providing a cantilever which fits within a groove of the pen carriage.

In accordance with another embodiment of the present invention, a pen carriage assembly includes a pen carriage for transporting a pen to dispense a substance, the pen carriage having a groove along a first side, and a pen carriage support having a cantilever which fits within the groove of the pen carriage and which supports the pen carriage.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

The preferred embodiments of the present invention and their advantages are best understood by referring to the detailed description that follows. It should be appreciated that like reference numerals are used to identify like elements illustrated in one or more of the figures.

DETAILED DESCRIPTION OF THE INVENTION

Figure 4:
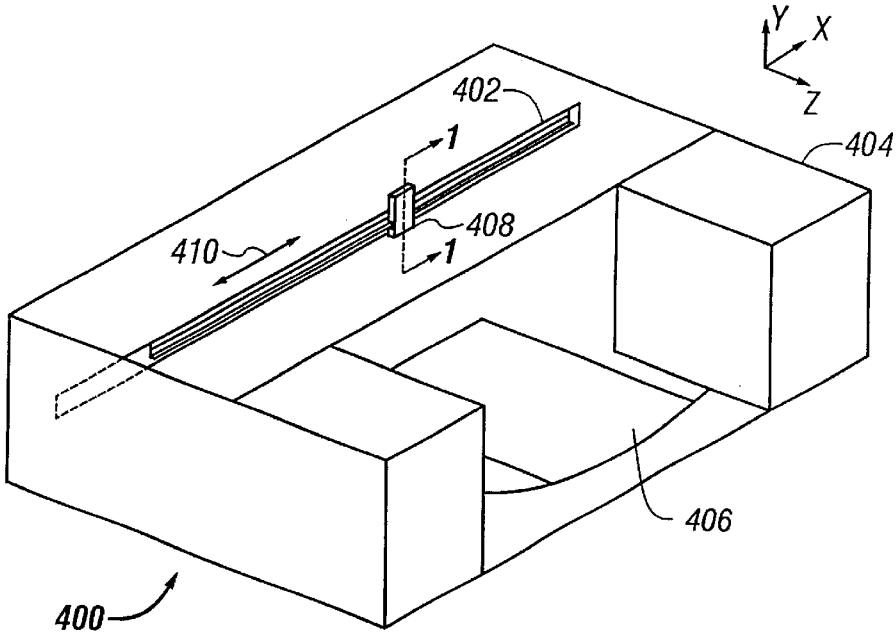
FIG. 4 shows a printer with a pen carriage support in accordance with an embodiment of the present invention.

FIG. 4 shows a printer 400 with a pen carriage support 402 in accordance with an embodiment of the present invention. Printer 400 includes a housing 404, a print media tray 406, and a pen carriage 408 supported by pen carriage support 402. Printer 400 is shown in general detail and represents any type of printer that transports a pen in some fashion to dispense ink or some other substance onto print media. For example, printer 400 may represent an ink-jet printer.

As an example of general operation, printer 400 transports, using a transport mechanism (not shown), a sheet of print media from print media tray 406. The sheet of print media, is passed in close proximity to pen carriage 408, which travels along a scan axis 410 (i.e., along the x-axis) on pen carriage support 402 and dispenses ink on a surface of the print media to generate a desired printed image. A drive belt or a cable or other means along with a motor, as known in the art, provides the force necessary to propel pen carriage 408 along the path provided by pen carriage support 402. Ribbon wire provides control signals to pen carriage 408 to energize associated electrical components and control the dispensing of the ink.

Pen carriage 408 may contain one or more cartridges, pens, or print heads to dispense one or more types of ink or other substances and which may be removable from pen carriage 408 or may be semi-permanent or permanent within pen carriage 408. For example, pen carriage 408 may include one or more ink-jet pens to provide black-and-white or color images.

Pen carriage support 402 may be made of wood, plastic, metal or metal alloy, or any other material that provides the necessary support and rigidity. For example, pen carriage support 402 comprises sheet metal that has been bent or cut and bent to form a ledge, cantilever, flange, or other type of support structure disclosed herein for pen carriage 408. It should be understood that the cut would generally not be the entire length of pen carriage support 402, but only over the portion or length that is intended to be traveled by pen carriage 408. Alternatively, pen carriage support 402 comprises a plastic or a composite-type material that has been formed or molded to a shape, as disclosed herein, to support pen carriage 408.

Figure 5:
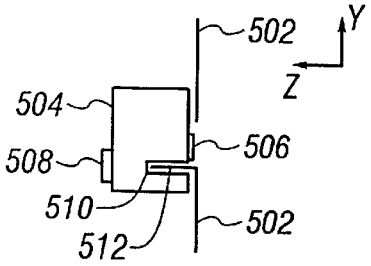
FIG. 5 shows a cross-sectional view along lines 1—1 in FIG. 4 for a pen carriage support in accordance with an embodiment of the present invention.

Pen carriage support 402 and pen carriage 408, shown generally in FIG. 4, are described in greater detail below in accordance with specific embodiments and illustrated in the corresponding figures. FIG. 5 shows a cross-sectional view along lines 1—1 in FIG. 4 for a pen carriage support 502 in accordance with an embodiment of the present invention. Pen carriage support 502 supports a pen carriage 504 that travels along pen carriage support 502.

Pen carriage support 502 provides a cantilever 512 that fits within a groove 510 (or slot) located in pen carriage 504. Pen carriage 504 slides along cantilever 512, which provides the necessary support and mechanical alignment. Groove 510 is a friction guide that fits snugly around cantilever 512 and allows pen carriage 504 to slide easily along scan axis 410. Alternatively, as discussed below, bushings, bearings, wheels, or other roller-type or slide-type devices may be incorporated to assist pen carriage 504 to slide smoothly along cantilever 512.

Cantilever 512 provides registration or mechanical support and alignment generally relative to the y-axis. To maintain proper alignment of pen carriage 504 along the z-axis, gravity may be employed such that the weight of pen carriage 504 resists movement away from pen carriage support 502 (i.e., resists movement in the positive z-axis direction).

Alternatively or in conjunction with gravity, the drive belt (or cable), that is used to move pen carriage 504, is attached to pen carriage 504 at, for example, a position 506 or a position 508. The drive belt would then limit or resist movement of pen carriage 504 in the positive z-axis direction due to the tension of the drive belt.

As discussed above, pen carriage support 502 may be made of any material that provides sufficient rigid mechanical support for pen carriage 504. For example, if pen carriage support 502 is formed by a sheet metal cut and fold process, the resulting metal shape will have inherit rigidity and become an integral part of the support structure. Furthermore, the process would be less expensive than prior art structures and easier to secure and align within printer 400. It should be understood that, as explained above, if a cut-and-bend process is performed, the cut would be generally only along a portion of pen carriage support 502 intended to be traveled by pen carriage 504.

Figure 6:
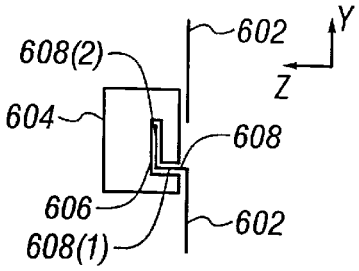
FIG. 6 shows a cross-sectional view along lines 1—1 in FIG. 4 for a pen carriage support in accordance with another embodiment of the present invention.

FIG. 6 shows a cross-sectional view along lines 1—1 in FIG. 4 for a pen carriage support 602 in accordance with another embodiment of the present invention. Pen carriage support 602 supports a pen carriage 604, which travels along pen carriage support 602, by providing a cantilever 608 that fits within a groove 606 of pen carriage 604. Groove 606 is a friction guide, but may include bushings or rollers as discussed herein (i.e., roller-type or slide-type devices), that allows pen carriage 604 to slide easily along scan axis 410.

Cantilever 608 provides registration or mechanical support and alignment relative to the y-axis and to the z-axis. As shown, cantilever 608 comprises a first segment (separately labeled and referenced as cantilever 608(1)) measured along the z-axis and a second segment (separately labeled and referenced as cantilever 608(2)) measured along the y-axis, which act to control movement of pen carriage 604 in both the y-axis and the z-axis. The drive belt or other means attached to pen carriage 604 controls its movement along the x-axis.

Figure 7:
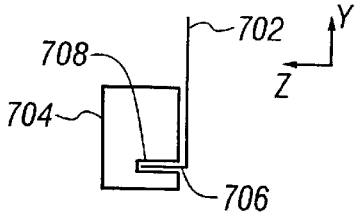
FIG. 7 shows a cross-sectional view along lines 1—1 in FIG. 4 for a pen carriage support in accordance with another embodiment of the present invention.

FIG. 7 shows a cross-sectional view along lines 1—1 in FIG. 4 for a pen carriage support 702 in accordance with another embodiment of the present invention. Pen carriage support 702 supports a pen carriage 704, which travels along pen carriage support 702, by providing a cantilever 706 that fits within a groove 708 of pen carriage 704. Pen carriage support 702 and pen carriage 704 are similar to pen carriage support 502 and pen carriage 504, respectively, with the difference being pen carriage support 702 forms cantilever 706 at one side of pen carriage support 702 rather than between its sides as with pen carriage support 502.

Figure 8:
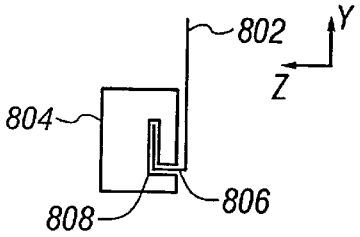
FIG. 8 shows a cross-sectional view along lines 1—1 in FIG. 4 for a pen carriage support in accordance with another embodiment of the present invention.

FIG. 8 shows a cross-sectional view along lines 1—1 in FIG. 4 for a pen carriage support 802 in accordance with another embodiment of the present invention. Pen carriage support 802 supports a pen carriage 804, which travels along pen carriage support 802, by providing a cantilever 806 that fits within a groove 808 of pen carriage 804. Pen carriage support 802 is similar to pen carriage support 602 (FIG. 6), with the main difference being cantilever 806 is formed at one side of pen carriage support 802 rather than between its sides as with pen carriage support 602.

Figure 9:
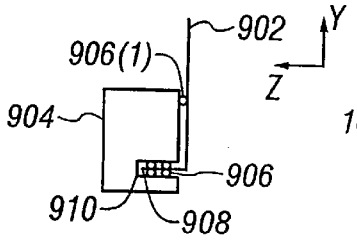
FIG. 9 shows a cross-sectional view along lines 1—1 in FIG. 4 for a pen carriage support in accordance with another embodiment of the present invention.

FIG. 9 shows a cross-sectional view along lines 1—1 in FIG. 4 for a pen carriage support 902 in accordance with another embodiment of the present invention. Pen carriage support 902 includes a cantilever 908 to support a pen carriage 904 using a groove 910, with pen carriage support 902 and pen carriage 904 similar to the structure shown in FIG. 7. However, pen carriage support 902 and pen carriage 904 differ by the addition of support structures 906, which may be part of pen carriage support 902 or pen carriage 904.

Support structures 906 serve to assist pen carriage 904 travel along pen carriage support 902 and may be positioned at various points between pen carriage support 902 and pen carriage 904. Support structures 906 may comprise friction-reducing ridges, bushings, bearings, rollers, wheels, or other roller-type or slide-type structures.

Figure 10:
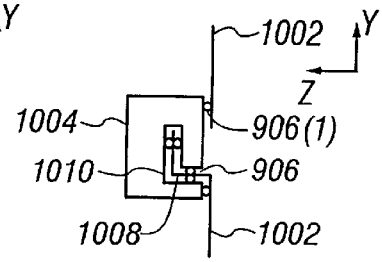
FIG. 10 shows a cross-sectional view along lines 1—1 in FIG. 4 for a pen carriage support in accordance with another embodiment of the present invention.

FIG. 10 shows a cross-sectional view along lines 1—1 in FIG. 4 for a pen carriage support 1002 in accordance with another embodiment of the present invention. Pen carriage support 1002 includes a cantilever 1008 to support a pen carriage 1004 using a groove 1010, with pen carriage support 1002 and pen carriage 1004 similar to the structure shown in FIG. 6. However, pen carriage support 1002 and pen carriage 1004 differ by the addition of support structures 906, which may be part of pen carriage support 1002 or pen carriage 1004.

As illustrated in FIGS. 9 and 10, support structures 906 may be incorporated into any of the embodiments discussed herein to aid in reducing friction and provide ease of movement of the pen carriage on the pen carriage support. Support structures 906 can also be positioned in various strategic load-bearing points. For example in FIG. 9, one of support structures 906, which is labeled as support structure 906(1), is positioned between pen carriage 904 and pen carriage support 902 to absorb some of the load or force exerted along the z-axis and reduce frictional forces.

Figure 1:
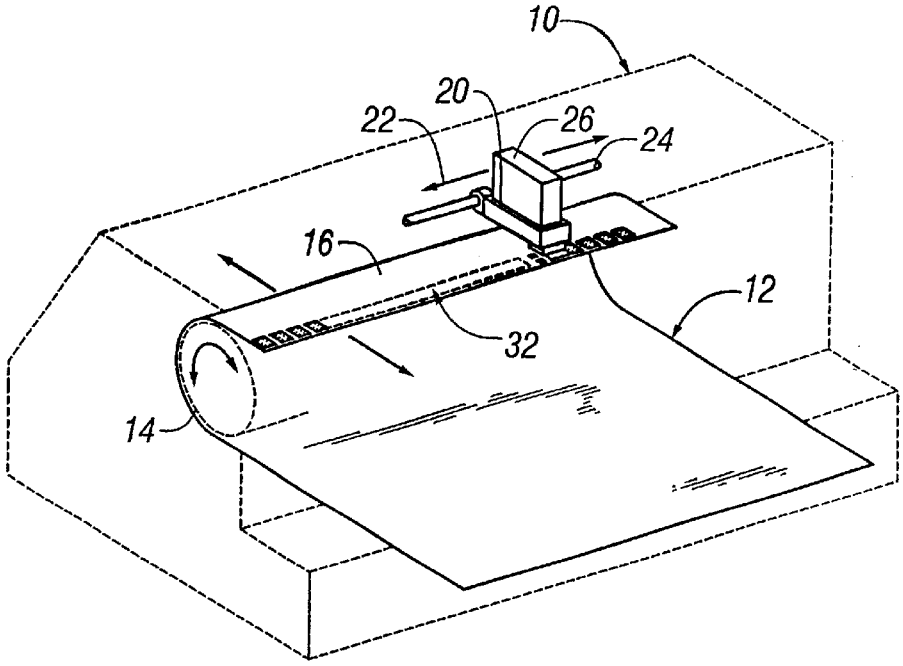
FIG. 1 (Prior Art)
FIG. 1 shows a conventional guide rod for a print cartridge.
Figure 3:
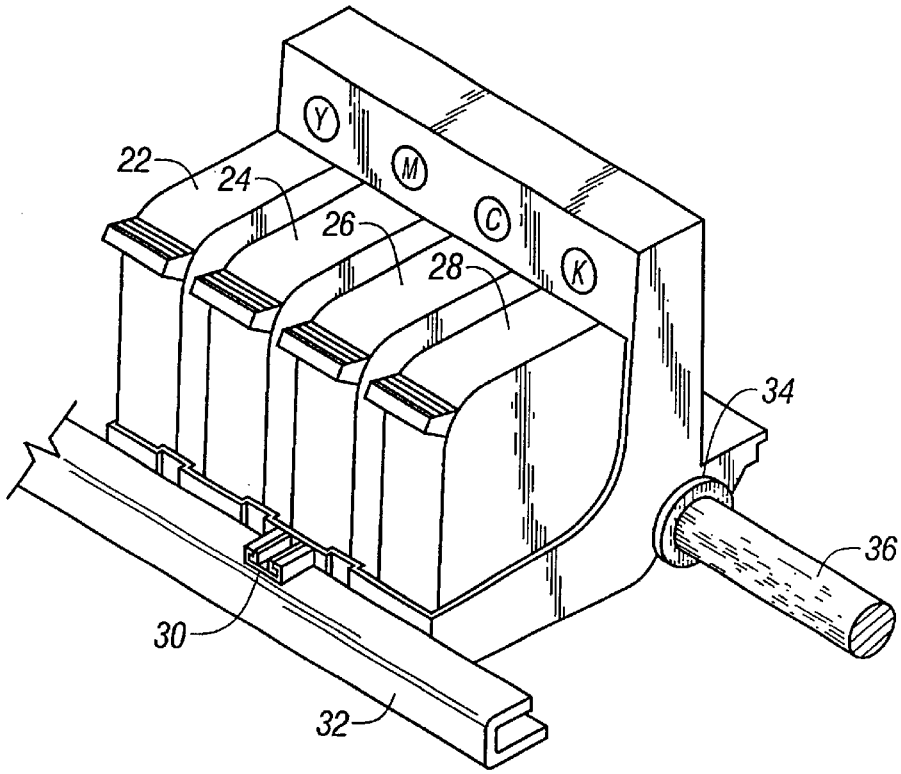
FIG. 3 (Prior Art)
FIG. 3 shows a conventional carriage support structure.
Figure 2:
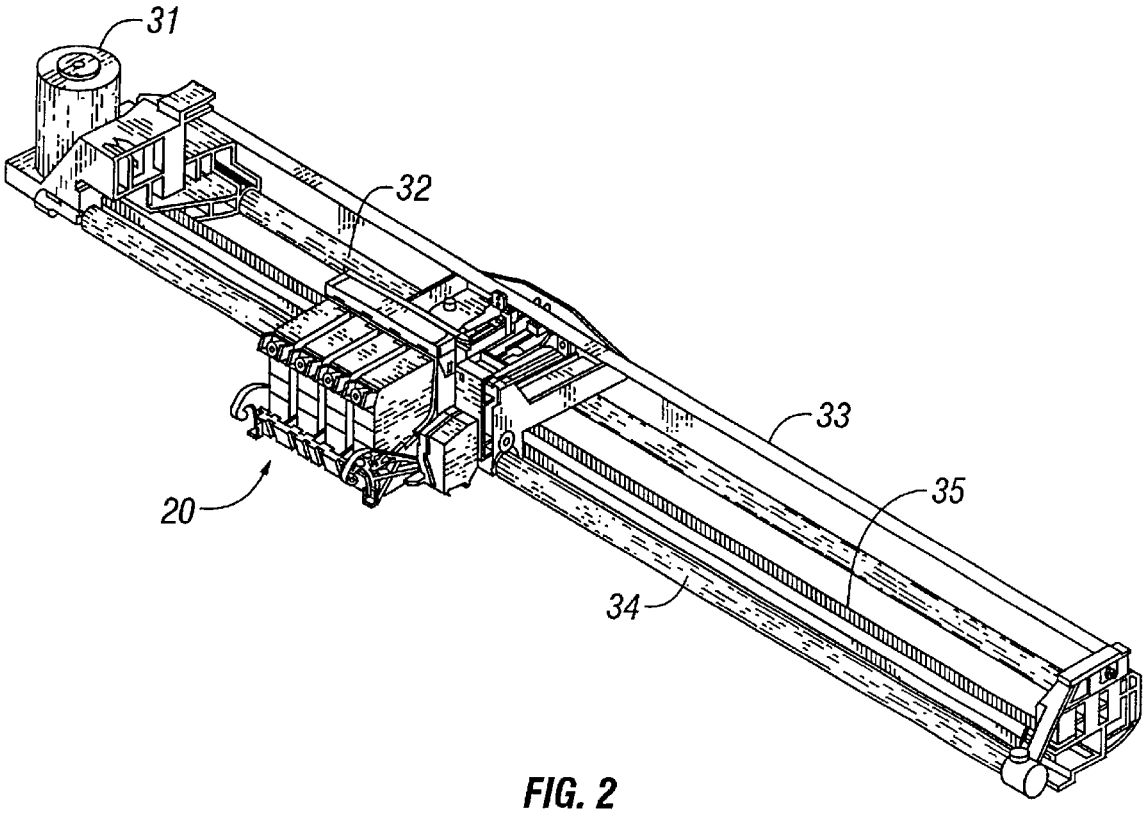
FIG. 2 (Prior Art)
FIG. 2 shows a conventional carriage assembly support structure.
Figure 11:
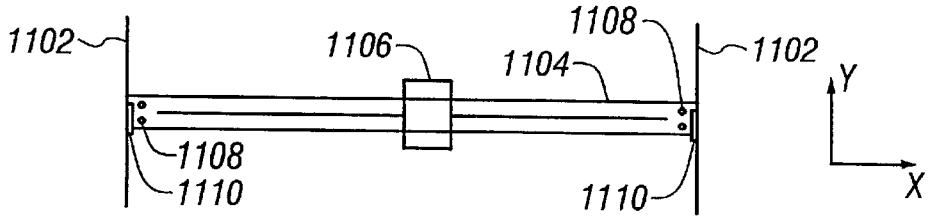
FIG. 11 shows a pen carriage support in accordance with another embodiment of the present invention.

FIG. 11 shows a pen carriage support 1104 in accordance with another embodiment of the present invention. Pen carriage support 1104 is shown supporting a pen carriage 1106 and is attached to chassis supports 1102. Chassis supports 1102 are part of or within housing 404 and serve to secure pen carriage support 1104. FIG. 11 serves to illustrate various attachment methods for securing various embodiments of the pen carriage support discussed herein within printer 400. For example, pen carriage support 1104 is shown fitting within grooves 1110 of chassis supports 1102. Alternatively or in addition to, pen carriage support 1104 may be secured by rivets, screws, or similar attachment devices, such as at points 1108.

Figure 12:
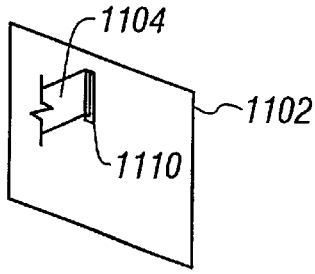
FIG. 12 shows a portion of a pen carriage support in accordance with another embodiment of the present invention.

FIG. 12 shows a portion of pen carriage support 1104, which illustrates how one end of pen carriage support 1104 can fit or snap into grooves 1110. Furthermore, each end of pen carriage support 1104 may be bent at a right angle and attachment devices, such as rivets or screws, used to secure pen carriage support 1104 to chassis supports 1102.

Embodiments described above illustrate but do not limit the invention. It should also be understood that numerous modifications and variations are possible in accordance with the principles of the present invention. Accordingly, the scope of the invention is defined only by the following claims.

We claim:

1. A printer comprising:

a housing;

a pen carriage that transports a pen for dispensing a substance onto a sheet of a print media transported near the pen carriage; and a pen carriage support coupled to the housing and which is coupled to and supports the pen carriage by providing a cantilever that fits within a groove of the pen carriage.

2. The printer of claim 1, wherein the cantilever completely supports the pen carriage.

3. The printer of claim 1, further comprising:

a motor coupled to the housing; and a drive belt coupled to the motor and to the pen carriage, the motor employing the drive belt to move the pen carriage along the pen carriage support.

4. The printer of claim 3, wherein the tension of the drive belt assists in retaining the pen carriage on the pen carriage support.

5. The printer of claim 1, further comprising at least one support structure disposed between the pen carriage support and the pen carriage.

6. The printer of claim 5, wherein the support structure comprises at least one of a bushing, a ridge, a bearing, a roller, and a wheel.

7. The printer of claim 1, wherein the cantilever comprises a first segment for substantially supporting the pen carriage along a first axis and a second segment for substantially supporting the pen carriage along a second axis.

8. The printer of claim 1, wherein the pen carriage support is coupled to the housing through each of its ends by fitted grooves within the housing.

9. The printer of claim 1, wherein the pen comprises an ink-jet cartridge, an ink pen, or a print head.

10. The printer of claim 1, wherein the pen carriage support is made of at least one of a wood, a plastic, a metal, or a metal alloy.

11. The printer of claim 1, wherein the pen carriage support is made of sheet metal and formed by a cut-and-bend process.

12. A pen carriage assembly comprising:

a pen carriage for transporting a pen to dispense a substance, the pen carriage having a groove along a first side; and a pen carriage support having a cantilever that fits within the groove of the pen carriage and which supports the pen carriage.

13. The pen carriage assembly of claim 12, further comprising a support structure disposed between the pen carriage support and the pen carriage.

14. The pen carriage assembly of claim 12, wherein the cantilever comprises a first segment for substantially supporting the pen carriage along a first axis and a second segment for substantially supporting the pen carriage along a second axis.

* * * * *